US005342721A

United States Patent [19]

Akamatsu

[11] Patent Number: 5,342,721

[45] Date of Patent: Aug. 30, 1994

[54] SILICONE RESIN COMPOSITION FOR USE AS A CARRIER COATING

[75] Inventor: Shoji Akamatsu, Chiba Prefecture, Japan

[73] Assignee: Dow Corning Toray Silicone Co., Ltd., Tokyo, Japan

[21] Appl. No.: 949,612

[22] Filed: Sep. 23, 1992

[30] Foreign Application Priority Data

Sep. 30, 1991 [JP] Japan ..... 3-278225

[51] Int. Cl.[5] ..... G03G 9/00

[52] U.S. Cl. ..... 430/108; 430/106.6; 430/904

[58] Field of Search ..... 430/108, 106.6, 904

[56] References Cited

U.S. PATENT DOCUMENTS

| | | | |
|---|---|---|---|
| 3,288,754 | 11/1966 | Green | 260/47 |
| 3,876,677 | 4/1975 | Wu | 260/448.2 B |
| 3,887,514 | 6/1975 | Merrill | 260/33.65 B |
| 4,520,075 | 5/1985 | Igarashi et al. | 428/435 |
| 4,549,003 | 10/1985 | Lim et al. | 528/42 |
| 4,977,054 | 12/1990 | Honjo et al. | 430/108 |
| 4,999,397 | 3/1991 | Weiss et al. | 524/755 |
| 5,085,964 | 2/1992 | Kawata et al. | 430/108 |

FOREIGN PATENT DOCUMENTS

| | | |
|---|---|---|
| 2834171 | 2/1980 | Fed. Rep. of Germany . |
| 284775 | 2/1986 | Japan . |
| 1204931 | 8/1989 | Japan . |
| 160259 | 6/1990 | Japan . |
| 790725 | 2/1983 | U.S.S.R. . |

*Primary Examiner*—Steve Rosasco
*Attorney, Agent, or Firm*—Robert Spector

[57] ABSTRACT

The present invention provides silicone resin-coated carrier particles used in two-component dry-process developers for electrophotographic processes. The present invention also provides a method for preparing carrier particles using a mixture of two silicone resin compositions.

6 Claims, No Drawings

SILICONE RESIN COMPOSITION FOR USE AS A CARRIER COATING

BACKGROUND OF THE INVENTION

1. Field of the Invention

The present invention relates to carrier particles used in the two-component dry-process developers employed in electrophotographic processes. More particularly, this invention relates to a silicone resin composition of specified composition useful for coating these carrier particles.

2. Background Information

In the electrophotographic process, a two-component dry-process developer is brought into contact with an electrostatic latent image on a photosensitive material in order to transfer and adhere the toner to the electrostatic latent image. This toner is subsequently transferred to the receiving sheet and is then fixed at elevated temperature. The two-component dry-process developer used in the electrophotographic process consists of a toner and carrier. The toner consists of thermoplastic resin and pigment, while the carrier consists of iron powder, glass powder, and similar materials. The toner is carried on the surface of the carrier through triboelectrification. In order to avoid the formation of a toner film on the carrier's surface (spanting), the surface of the carrier is coated with a cured film of a silicone resin or a similar toner releasing material.

Numerous silicone resin compositions are already known for the purpose of coating the surface of the carrier in two-component dry-process developers. Examples of useful silicone resins include but are not limited to compositions comprising a silanol-containing organopolysiloxane (Japanese Patent Application Laid-Open [Kokai or Unexamined] Number 56-106968 [106,968/1981]), an organotin compound and an organopolysiloxane comprising difunctional siloxane units (D unit) and trifunctional siloxane units (T unit) (Japanese Patent Application Laid-Open Number 61-284775 [284,775/1986]), and a silicone resin composition composed of a methylphenylsiloxane resin exhibiting a molar ratio of Si-bonded organic groups to silicon atoms no larger than 1.5 (Japanese Patent Application Laid-Open Number 2-160259 [160,259/1990]).

Each of these prior art silicone resin compositions requires heating to 200° to 250° C. after coating on the carrier surface in order to bring about curing of the coated film. This requirement also places limitations on the range of useable carriers. Moreover, due to the high electrical resistance of the cured films derived from silicone resins, the use of carriers coated with such resins in two-component dry-process developers has been associated with problems such as edge development, low image density, and the like. As a consequence, another problem confronting the prior art has been the necessity to adjust the electrical resistance of the silicone resin and find a silicone resin-coated carrier that affords a toner charge in the range of 10 to 30 microcoul/g.

Prior methods for carrier preparation have also involved dilution of the silicone resin composition with large quantities of organic solvent. This organic solvent must be removed after the silicone resin composition has been coated on the carrier surface, which results in degradation of the working environment.

The present invention was arrived at as the result of extensive investigations directed at solving the foregoing problems associated with prior art carrier coating materials.

One object of the present invention is the introduction of a silicone resin composition suitable for carrier coating and a process for carrier production that are both free of the problems associated with prior art resins and processes.

A second objective of this invention is to provide a carrier-coating silicone resin composition that, after coating on the carrier surface, cures rapidly at temperatures no greater than 150° C. to yield a cured film having an optimal electrical resistance value.

Another objective of the this invention is to provide a carrier production method that does not require use of organic solvents.

SUMMARY OF THE INVENTION

The present invention provides carrier particles coated with a silicone resin composition. The composition comprises a reacted mixture of a resin containing silicon-bonded aminoalkyl radicals and a resin containing silicon bonded haloalkyl radicals or epoxide-containing groups. The present invention also provides a method for preparing carrier particles using these compositions.

DETAILED DESCRIPTION OF THE INVENTION

The present invention relates to a carrier for use in electrophotographic processes, said carrier comprising a particulate material coated with a silicone resin composition comprising the reaction product of (A) an aminoalkyl-substituted organopolysiloxane of the general formula $$(R^1SiO_{3/2})_m(R^1{}_2SiO)_n$$

where at least one $R^1$ represents an aminoalkyl radical, any remaining $R^1$ substituents are individually selected from the group consisting of monovalent hydrocarbon radicals and m and n are positive numbers, and (B) a haloalkyl- or epoxy-substituted organopolysiloxane of the general formula $$(R^2SiO_{3/2})_p(R^2{}_2SiO)_q$$

where at least one $R^2$ represents an epoxy-containing group or a haloalkyl radical, any remaining $R^2$ substituents are individually selected from the group consisting of monovalent hydrocarbon radicals, p and q are positive numbers and the softening points of organopolysiloxanes A and B are equal to or greater than room temperature.

The present invention also provides a method for preparing the present carrier particles that is characterized by (1) mixing a particulate carrier material with a coating composition comprising a mixture of the organopolysiloxanes identified as ,A and B in the preceding section of this specification while heating said carrier material to at least the softening points of said organopolysiloxanes in order to coat the surface of the carrier material with the coating composition, and (2) subsequently heating the coating composition to react said organopolysiloxanes.

Organopolysiloxane A contains aminoalkyl-substituted silicon atoms, has a softening point equal to or greater than room temperature and is represented by the general formula $$(R^1SiO_{3/2})_m(R^1{}_2SiO)_n$$

Organopolysiloxane B contains haloalkyl or epoxy-substituted silicon atoms, has a softening point equal to or greater than room temperature and is represented by the general formula $$(R^2SiO_{3/2})_p(R^2{}_2SiO)_q$$

In these formulae at least one of the $R^1$ substituents is an aminoalkyl radical, at least one of $R^2$ substituents is a haloalkyl radical or an epoxy-containing group, any remaining $R^1$ and $R^2$ substituents are identical or different monovalent hydrocarbon radicals and p and q are positive numbers.

Organopolysiloxane A contains difunctional siloxane units (D units), and trifunctional siloxane units (T units). Ingredient A may also optionally contain monofunctional siloxane units (M units) represented by the general formula $(R1)3SiO_{\frac{1}{2}}$ and/or tetrafunctional siloxane units (Q units) represented by the general formula $SiO_{4/2}$, so long as the objectives of the present invention are not comprimised.

At least one of the substituents represented by $R^1$ that appears in the general formula for the units of ingredient A is an aminoalkyl radical and the remaining $R^1$ substituents are identical or different monovalent hydrocarbon radical exemplified by but not limited to alkyl radicals such as methyl, ethyl, and propyl; alkenyl radicals such as vinyl, allyl, and butenyl; aryl radicals such as phenyl and tolyl; and aralkyl radicals such as benzyl and phenethyl.

The aminoalkyl radicals are exemplified by aminomethyl, 2-aminoethyl, 3-aminopropyl, 4-aminobutyl, and N-(2-aminoethyl)-3-aminopropyl.

The subscripts m and n in the general formula for organopolysiloxane A are positive numbers, and their values define the ratio between the T and D units.

The method for synthesizing organopolysiloxane A is not specifically restricted. The following exemplify suitable methods for synthesis of this ingredient:

I. Cohydrolysis of a hydrocarbyl-substituted trihalosilane and a hydrocarbyl substituted dihalosilane, followed by reaction with an aminoalkyl-substituted alkoxysilane ;

II. Cohydrolysis of a hydrocarbyl substituted trialkoxysilane and a hydrocarbyl substituted dialkoxysilane, followed by condensation with an aminoalkyl-substituted alkoxysilane; and III. Cohydrolysis of a hydrocarbyl-substituted alkoxysilane, hydrocarbyl-substituted trialkoxysilane and an aminoalkyl-containing alkoxysilane.

The organopolysiloxane comprising ingredient (A) can range from low-viscosity liquid organopolysiloxanes to organopolysiloxanes that are solid at room temperature; however, organopolysiloxanes having a softening point at or above room temperature are preferred in order to facilitate handling. For example, preferred organopolysiloxanes will have a softening point in the range of 50° to 150° C.

The organopolysiloxane comprising ingredient (B) contains D and T units and has the general formula $$(R^2SiO_{3/2})_p(R^2{}_2SiO_{2/2})_q$$

where at least one of the $R^2$ substituents is a haloalkyl radical or an epoxy-containing group. The remaining $R^2$ units represent monovalent hydrocarbon radicals exemplified by but not limited to alkyl radicals such as methyl, ethyl, and propyl; alkenyl radicals such as vinyl, allyl, and butenyl; aryl radicals such as phenyl and tolyl; and aralkyl radicals such as benzyl and phenethyl.

The haloalkyl radicals are exemplified by chloromethyl, bromomethyl, 2-chloroethyl, 3-chloropropyl, and 3-bromopropyl; and the epoxy-containing organic groups are exemplified by 3-glycidoxypropyl and 3,4-epoxycyclohexylethyl. The subscripts p and q are both positive numbers, and their values define the ratio between T and D units.

In addition to D and T units, organopolysiloxane B may also optionally contain M units represented by the general. formula $(R^2)_3SiO_{\frac{1}{2}}$ and/or Q units represented by the general formula $SiO_{4/2}$, so long as the objectives of the present invention are not comprimised.

The method for synthesizing the organopolysiloxane identified as ingredient B is not specifically restricted, and include but are not limited to the same methods described in the preceding section of this specification for ingredient A, with the exception that the aminoalkyl-functional silane is replaced with either a haloalkyl- or epoxy-functional silane.

Ingredient B can range from a low-viscosity liquid organopolysiloxane to organopolysiloxanes that are solid at room temperature. Organopolysiloxanes having a softening point equal to or above room temperature are preferred in order to facilitate handling. For example, preferred organopolysiloxanes for use as ingredient B have a softening point in the range of 50° to 150° C.

As a consequence of the use of the aminoalkyl-containing organopolysiloxane identified as ingredient A of the present composition, the cured resin film prepared using the carrier-coating silicone resin composition has an optimal electrical resistance for carrier-coating applications. When this carrier is used in combination with a toner in a two-component dry-process developer, the toner will have an optimal charge of 10 to 30 microcoul/g. The use of the haloalkyl-containing organopolysiloxane identified as ingredient B is advantageous because this lowers the electrical resistance of the cured film.

The present resin compositions can be prepared by mixing ingredients A and B to homogeneity. The molar ratio between the aminoalkyl groups in ingredient A and the haloalkyl or epoxy-containing groups in ingredient B should be from 1:0.1 to 1:10 and preferably from 1:0.5 to 1:5.

When ingredients A and B are both solid at room temperature, a quick-curing single-package carrier-coating silicone resin composition can be prepared by mixing ingredients A and B to homogeneity after they have been ground. This type of composition has a good storage stability at room temperature. The reaction between ingredients A and B occurs when these ingredients are heated at least to their softening points.

Alternatively, a reaction between ingredients A and B can be achieved by blending solutions of these ingredients in identical or miscible organic liquid. Because the curing reaction proceeds even at room temperature in this case, mixing must be carried out immediately before use. Organic solvents operable in this process include but are not limited to aromatic solvents such as toluene and xylene, aliphatic solvents such as hexane and heptane, ketone solvents such as acetone and methyl ethyl ketone, as well as tetrahydrofuran and dioxane. The usual methods of carrier preparation can be used when a solvent is employed. These method include but are not limited to immersion, spray coating, and use of a fluidized-bed.

The method of carrier preparation according to the present invention will now be considered in greater detail.

No specific restrictions are placed on the carrier used by the present invention for application in two-component dry-process developers. Particulate materials from which carrier particles can be formed include but are not limited to magnetic materials such as iron, nickel, cobalt, ferrite, and magnetite, and by tin oxide, silver, steel, bronze, carborundum, glass beads, graphite, carbon black, molybdenum sulfide, aluminum and silicon dioxide. Generally preferred particle sizes for the carrier are from 30 to 1,000 micrometers, the range from 50 to 500 micrometers being particularly preferred.

The present method for preparing carrier particles uses ingredients A and B , both of which preferably exhibit a softening point at least equal to room temperature. The present method for producing carrier particles comprises mixing a particulate carrier and a carrier-coating composition composed of ingredients A and B while heating to at least the softening points of these ingredients in order to coat the surface of the carrier particles with said composition, and then subsequently curing the resultant coating layer.

The carrier production method according to the present invention utilizes the reaction that can occur between the aminoalkyl groups of ingredient A and the haloalkyl radicals or epoxy-containing organic groups present in ingredient B when these ingredients are heated to at least their softening points to form a tacky liquid. The existence of this tacky liquid enables the combination of ingredients A and B to coat the carrier surface during mixing with the carrier particles.

The relative amounts of carrier particles and coating composition is governed by the surface area of the carrier and is not specifically restricted as long as coverage of the carrier surface is obtained. The thickness of the coating formed on the carrier surface is also not specifically restricted, but is preferably in the range of from 0.5 to 50 micrometers.

The mixing time should be long enough to provide for formation of a cured film by the reaction between ingredients A and B on the carrier surface. For example, the mixing time is within the range of from 0.5 to 5 hours when the mixing temperature is greater than or equal to the softening points of ingredients A and B, and in particular when the mixing temperature falls within the range of 50° to 150° C.

The device for mixing the carrier particles with the coating composition is again not specifically restricted. Any device generally capable of carrier coating can be used. Suitable devices include but are not limited to Ross mixers and kneader mixers.

EXAMPLES

The following examples describe preferred embodiments of the present coating compositions and carrier coating process, and should not be interpreted as limiting the scope of the invention defined in the accompanying claims. In tile examples, the viscosity is the value measured at 25° C., and the softening point of the organopolysiloxane was measured using a precision melting-point measurement device from Shibata Kagaku Kabushiki Kaisha. The following abbreviations are used in the examples: Ph for phenyl and Me for methyl.

REFERENCE EXAMPLE 1

Synthesis of an organopolysiloxane containing the N-(2-aminoethyl)-3-aminopropyl group Into a 2 L round bottom flask equipped with stirrer, thermometer, and addition funnel were placed 100 g water, 100 g isopropyl alcohol, and 400 g toluene. While stirring, a liquid mixture of 297 g (approximately 1.4 mol) phenyltrichlorosilane, 76 g (approximately 0.3 mol) diphenyldichlorosilane, and 39 g (approximately 0.3 mol) dimethyldichlorosilane was added dropwise to the reactor over 1 hour. The reaction mixture was heated at the boiling point for an additional 2 hours following completion of this addition, at which time the reaction mixture was allowed to cool while stirring was continued. When stirring was discontinued the lower aqueous layer was removed from the quiescent reaction mixture. 600 g of a 10% aqueous sodium bicarbonate solution were added to the reactor followed by stirring for 30 minutes, and removal of the lower aqueous layer from the quiescent reaction mixture.

The following process was then carried out twice: addition of 600 g water, stirring for 30 minutes, quiescence, and removal of the lower aqueous layer. Water and toluene were then distilled from the resulting toluene solution, which was present as the upper layer in the reactor, followed by concentration of the residue at 150° C. until the volume was approximately 50% of the initial volume. The resulting toluene solution of organopolysiloxane had a viscosity of 6 cp.

Into 500 g of this solution was introduced 25 g of N-(2-aminoethyl)-3-aminopropylmethyldimethoxysilane. Heating and stirring or the resultant mixture for 5 hours at the reflux temperature followed by cooling yielded a toluene solution of an organopolysiloxane containing the N-(2-aminoethyl)-3-aminopropyl group. Evaporation of the solvent under reduced pressure yielded an N-(2-aminoethyl)-3-aminopropyl-containing organopolysiloxane that was solid at room temperature with a softening point of 75° C. This organopolysiloxane was confirmed by nuclear magnetic resonance spectroscopic analysis to be composed of 65.7 mol % $PhSiO_{3/2}$ units, 14.4 mol % $Ph_2SiO_{2/2}$ units, 13.9 mol % $Me_2SiO_{2/2}$ units, and 6.0 mol % $NH_2C_2H_4NHC_3H_6(CH_3)SiO_{2/2}$ units.

REFERENCE EXAMPLE 2

Synthesis of a 3-chloropropyl-containing organopolysiloxane

Into a 2 L round bottom flask equipped with stirrer, thermometer, and addition funnel were placed 100 g water, 100 g isopropyl alcohol, and 400 g toluene. While stirring, a liquid mixture of 297 g (approximately 1.4 mol) phenyltrichlorosilane and 39 g (approximately 0.3 mol) dimethyldichlorosilane was added dropwise to the reactor over 1 hour. The reaction mixture was heated at the boiling point for an additional 2 hours following completion of the addition, and the reaction mixture was allowed to cool. Following cooling, the stirrer was stopped and the lower aqueous layer was removed from the quiescent reaction mixture. 600 g of a 10% aqueous sodium bicarbonate solution was then added to the reactor followed by stirring for 30 minutes, quiescence, and removal of the lower aqueous layer.

The following process was then carried out twice: addition of 600 g water, stirring for 30 minutes, quiescence, and removal of the lower aqueous layer. Water and toluene were distilled from the resulting toluene solution using an evaporator and the resulting mixture was reduced to 50% of its initial volume by distillation at 150° C. The resulting toluene solution of the organopolysiloxane had a viscosity of 6 cp.

Into 500 g of this solution was then introduced 25 g of 3-chloropropylmethyldimethoxysilane. Heating and stirring of the reaction mixture for 5 hours at the reflux temperature followed by cooling yielded a toluene solution of an organopolysiloxane containing silicon-bonded 3-chloropropyl radicals. Removal of the solvent under reduced pressure yielded a 3-chloropropyl-substituted organopolysiloxane that was solid at room temperature and had a softening point of 120° C.

This organopolysiloxane was confirmed by the results from nuclear magnetic resonance spectroscopic analysis to be an organopolysiloxane composed of 70 mol % $PhSiO_{3/2}$ units, 15 mol % $Me_2SiO$ units, and 15 mol % $C1C_3H_6CH_3)SiO$ units.

REFERENCE EXAMPLE 3

Synthesis of a 3-glycidoxypropyl-containing organopolysiloxane

Into a 2 L round bottom flask equipped with stirrer, thermometer, and addition funnel were placed 100 g water, 100 g isopropyl alcohol, and 400 g toluene. While stirring, a liquid mixture of 297 g (approximately 1.4 mol) phenyltrichlorosilane, 76 g (approximately 0.3 mol) diphenyldichlorosilane, and 39 g (approximately 0.3 mol) dimethyldichlorosilane was added dropwise to the reaction mixture over 1 hour. The reaction mixture was heated at the reflux temperature for an additional 2 hours following completion of the addition. Then, after cooling, the stirrer was stopped and the lower aqueous layer was removed from the quiescent reaction mixture. 600 g 10% aqueous sodium bicarbonate were then added to the reaction mixture, followed by stirring for 30 minutes, quiescence, and removal of the lower (aqueous) layer.

The following process was then carried out twice: addition of 600 g water, stirring for 30 minutes, quiescence, and removal of the lower aqueous layer. Water and toluene were distilled from the resulting toluene solution using an evaporator and the volume of the resultant mixture was reduced to about 50% of its initial value by evaporation at 150° C. The resulting toluene solution of the organopolysiloxane had a viscosity of 6 cp.

Into 500 g of this toluene solution was then introduced 25 g of 3-glycidoxypropylmethyldimethoxysilane. Heating and stirring of the reaction mixture for 5 hours at the reflux temperature followed by cooling yielded a toluene solution of organopolysiloxane containing the 3-glycidoxypropyl group. Removal of the solvent under reduced pressure yielded a 3-glycidoxypropyl-containing organopolysiloxane that was solid at room temperature. This organopolysiloxane had a softening point of 82° C. and was confirmed by nuclear magnetic resonance spectroscopic analysis to be composed of 65.8 mol % $PhSiO_{3/2}$ units, 14.4 mol % $Ph_2SiO$ units, 14.2 mol % $Me_2SiO$ units, and 5.6 mol % of units of the formula

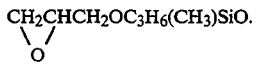

EXAMPLE 1

A carrier-coating silicone resin composition of this invention was prepared by mixing to homogeneity equal weights of 1) the toluene solution of organopolysiloxane containing the N-)2-aminoethyl)-3-aminopropyl group prepared as described in Reference Example 1 and 2) the toluene solution of the 3-chloropropyl-containing organopolysiloxane as prepared as described in Reference Example 2. This composition was coated on an aluminum panel. The film drying time (tack-free time) was measured at room temperature, and the percent of total cure at various time intervals was measured by heating the coated panel in a forced convection oven maintained at 150° C. This composition was also cured for one hour at 150° C., and the volume resistivity of the resulting cured film was measured. The results of these measurements are reported in Table 1.

A carrier-coating silicone resin composition of this invention was also prepared by mixing to homogeneity equal weights of 1) the solid organopolysiloxane containing the N-(2-aminoethyl)-3-aminopropyl group, prepared in Reference Example 1 and 2) the solid 3-chloropropyl-containing organopolysiloxane prepared as described in Reference Example 2. Using a kneader mixer, 10 g of the resultant mixture and 1 kg ferrite powder having an average particle size of 100 micrometers were mixed for 10 minutes at room temperature and then for 1 hour while heating to 150° C. The resulting ferrite powder had excellent flow properties. 30 g of this coated ferrite powder and 1 g carbon black-based toner were shaken for 10 minutes using a shaker, and the toner charge was then measured using a blow-off powder charge measurement device from Toshiba Chemical Kabushiki Kaisha. The toner charge after blow-off (30 seconds) was 23 microcoul/g, thus confirming this carrier to be ideal for us in an electrophotographic process.

EXAMPLE 2

A carrier-coating silicone resin composition of this invention was prepared by mixing to homogeneity equal weights of 1) the toluene solution of organopolysiloxane containing the N-(2-aminoethyl)-3-aminopropyl group prepared as described in Reference Example 1 and 2) the toluene solution of 3-glycidoxypropyl-containing organopolysiloxane prepared as described in Reference Example 3. The resultant mixture was coated onto an aluminum panel. The film drying time (tack-free time) was measured at room temperature, and the percent of total cure achieved at various time intervals at was measured by heating the coated panel in a forced convection oven maintained at 150° C. In addition, this composition was cured for one hour at 150° C., and the volume resistivity of the resulting cured film was measured.

The results of these measurements are also reported in Table 1.

A carrier-coating silicone resin composition of this invention was prepared by mixing to homogeneity equal weights of 1) the solid organopolysiloxane containing the N-(2-aminoethyl)-3-aminopropyl group prepared as described in Reference Example 1 and 2) the solid 3-glycidoxypropyl-containing organopolysiloxane prepared as described in Reference Example 3. Using a kneader mixer, 10 g of this composition and 1 kg ferrite powder having an average particle size of 100 micrometers were mixed for 10 minutes at room temperature and then for 1 hour while heating to 150° C. The resulting ferrite powder had excellent flow properties. 30 g of this ferrite powder and 1 g carbon black-based toner were shaken for 10 minutes in a shaker, and the toner charge was then measured using a blow-off powder charge measurement device from Toshiba Chemical Kabushiki Kaisha. The toner charge after blow-off (30 seconds) was 28 microcoul/g, thus confirming this carrier to be ideal for use in electrophotographic processes.

COMPARISON EXAMPLE 1

For purposes of comparison, a commercial carrier-coating silicone resin composition was diluted with toluene to form a 50 weight % solution. This commercial carrier-coating silicone resin composition consisted of dibutyltin diacetate and a silanol-containing organopolysiloxane composed of 85 mol % $MeSiO_{3/2}$ units and 15 mol % $Me_2SiO$ units. This coated carrier was evaluated using the same methods described in Example 1, and these results are also reported in Table 1.

COMPARISON EXAMPLE 2

For purposes of comparison with the present carrier composition, a commercial carrier-coating silicone resin composition was diluted with toluene to form a 50 weight % solution. This commercial carrier-coating silicone resin composition consisted of a silanol-containing organopolysiloxane composed of 25 mol % $MeSiO_{3/2}$ unit, 19 mol % $Me_2SiO$ unit, 37 mol % $PhSiO_{3/2}$ unit, and 19 mol % $Ph_2SiO$ unit. This resin was evaluated using the same methods described in Example 1, and the results are also reported in Table 1.

TABLE 1

| | Present Invention | | Comparison Examples | |
|---|---|---|---|---|
| Physical Properties | Example 1 | Example 2 | Comp. Example 1 | Comp. Example 2 |
| tack-free time (min.) | <30 | <30 | <30 | >120 |
| Percent Cure at T Min. T= | | | | |
| 10 minutes | 98 | 98 | 73.9 | 0.5 |
| 60 minutes | 100 | 100 | 89.5 | 10.9 |
| 120 minutes | 100 | 100 | 100 | 25.5 |
| Volume Resistivity (ohm · cm) | $7 \times 10^{11}$ | $3 \times 10^{13}$ | $2 \times 10^{15}$ | $6 \times 10^{14}$ |

The preceding examples demonstrate that the present carrier-coating silicone resin compositions cure rapidly at relatively low temperatures to yield a film with excellent electrical properties. In addition, the method for carrier preparation according to the present invention provides a carrier with excellent electrical properties without the use of organic solvent.

That which is claimed is:

1. A carrier for use in electrophotographic processes, said carrier comprising a particulate material coated with a silicone resin composition comprising the reaction product of (A) an aminoalkyl-containing organopolysiloxane of the general formula $$(R^1SiO_{3/2})_m(R^1{}_2SiO)_n$$

where at least one $R^1$ represents an aminoalkyl group and the remaining $R^1$ are identical or different monovalent hydrocarbon radicals, m and n are positive numbers, and (B) an organopolysiloxane containing haloalkyl or epoxy-containing organic groups and represented by the formula $$(R^2SiO_{3/2})_p(R^2{}_2SiO)_q$$

where at least one $R^2$ is selected from the group consisting of haloalkyl and epoxy-containing organic groups, the remaining R2 are identical or different monovalent hydrocarbon radicals, and p and q are positive numbers.

2. A carrier according to claim 1 where the softening points of organopolysiloxanes A and B are at least equal to room temperature, each $R^1$ and $R^2$ are individually selected from the group consisting of alkyl and aryl radicals, the molar ratio of the aminoalkyl radicals in organopolysiloxane A to haloalkyl radicals or epoxy-containing groups in organopolysiloxane B is from 0.1 to 10, and the particle size of said carrier is from 30 to 1000 millimicrons.

3. A carrier according to claim 2 where the softening points of organopolysiloxanes A and B are from 50° to 150° C., each $R^1$ and $R^2$ are individually selected from phenyl and methyl, with the proviso that at least one $R^1$ and one $R^2$ are phenyl, said molar ratio is from 0.2 to 2, the particle size of said carrier is from 50 to 500 micrometers, the thickness of the coating of said silicone resin is from 0.5 to 50 micrometers, said epoxy-containing group is 3-glycidoxypropyl, and said haloalkyl radical is 3-chloropropyl.

4. A method for coating carrier particles used in electrophotographic processes, said method comprising the steps of 1) blending said particles with a liquid or solubilized mixture of a first organopolysiloxane and a second organopolysiloxane and heating the resultant mixture at not less than the softening points of said first and second organopolysiloxanes, thereby coating the surface of the carrier with said composition, and 2) subsequently curing the resultant coating layer by the reaction of said first and second organopolysiloxanes, where said first organopolysiloxane exhibits a softening point at least equal to room temperature and has the general formula $$(R^1SiO_{3/2})_m(R^1{}_2SiO_{2/2})_n$$

where at least one of $R^1$ represents an aminoalkyl group and the remaining $R^1$ are identical or different monovalent hydrocarbon radicals, and m and n are positive numbers, and said second organopolysiloxane exhibits a softening point at least equal to room temperature and has the general formula $$(R^2SiO_{3/2})_p(R^2{}_2SiO)_q$$

where at least one $R^2$ represents a haloalkyl or an epoxy-containing organic group, the remaining $R^2$ represent monovalent hydrocarbon radicals, and p and q are positive numbers.

5. A method according to claim 4 where the softening points of organopolysiloxanes A and B are at least equal to room temperature, each $R^1$ and $R^2$ are individually selected from the group consisting of alkyl and aryl radicals, the molar ratio of the aminoalkyl radicals in organopolysiloxane A to haloalkyl radicals or epoxy-containing groups in organopolysiloxane B is from 0.1 to 10, and the particle size of said carrier is from 30 to 1000 millimicrons.

6. A method according to claim 5 where the softening points of organopolysiloxanes A and B are from 50° to 150° C., each $R^1$ and $R^2$ are individually selected from phenyl and methyl, with the proviso that at least one $R^1$ and one $R^2$ are phenyl, said molar ratio is from 0.2 to 2, the particle size of said carrier is from 50 to 500 micrometers, the thickness of the coating of said silicone resin is from 0.5 to 50 micrometers, said epoxy-containing group is 3-glycidoxypropyl, and said haloalkyl radical is 3-chloropropyl, and the reaction of organopolysiloxanes A and B is conducted while said organopolysiloxanes are in the liquid state at a temperature from 50° to 150° C.

* * * * *